United States Patent [19]

Schafer et al.

[11] 3,979,442

[45] Sept. 7, 1976

[54] DIESTER-AMINE ADDUCTS AND PROCESS FOR THEIR MANUFACTURE

[75] Inventors: Paul Schafer, Riehen; Jutta Ibrahim, Neuallschwil; Hanspeter Gysin, Muttenz, all of Switzerland

[73] Assignee: Ciba-Geigy Corporation, Ardsley, N.Y.

[22] Filed: Aug. 15, 1973

[21] Appl. No.: 388,525

[30] Foreign Application Priority Data

Aug. 21, 1972 Switzerland ..... 12348/72

[52] U.S. Cl. ..... 260/482 P; 252/8.8

[51] Int. Cl.$^2$ ..... C07C 101/26

[58] Field of Search ..... 260/482 P

[56] References Cited

UNITED STATES PATENTS

| | | | |
|---|---|---|---|
| 3,077,487 | 2/1963 | Ramsey et al. | 260/482 P |
| 3,158,635 | 11/1964 | Kezerian | 260/482 P |

FOREIGN PATENTS OR APPLICATIONS

| | | | |
|---|---|---|---|
| 1,373,033 | 8/1964 | France | 260/482 P |
| 757,704 | 9/1956 | United Kingdom | 260/482 P |

*Primary Examiner*—Paul J. Killos

*Attorney, Agent, or Firm*—Joseph G. Kolodny; Edward McC. Roberts; Prabodh I. Almaula

[57] ABSTRACT

Diester-amine adducts of the formula

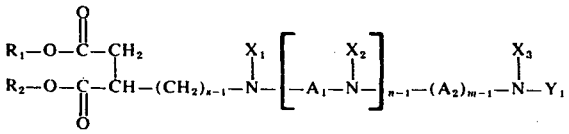

(1)

are provided, wherein $A_1$ and $A_2$ each denote alkyklene with 2 or 3 carbon atoms or 2-hydroxy-n-propylene, $X_1$, $X_2$ and $X_3$ each denote hydrogen, alkyl with 1 to 4 carbon atoms or hydroxyalkyl or hydroxyhalogenoalkyl with 2 to 4 carbon atoms or a radical of the formula

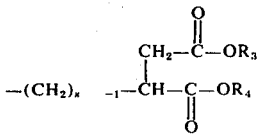

(1.1)

and, if $n$ is 3 or 4, the individual $X_2$ radicals are identical or different, $Y_1$ denotes hydrogen, alkyl with 1 to 4 carbon atoms or a radical of the formula

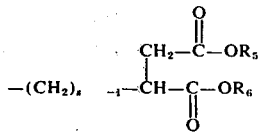

(1.2)

wherein $R_1$, $R_2$, $R_3$, $R_4$, $R_5$ and $R_6$ each denote alkyl or alkenyl with 12 to 22 carbon atoms, m, s, s' and s'' denote 1 or 2 and $n$ denotes 1, 2, 3 or 4, with the ratio of the diester groups to the nitrogen atoms bein at most 1:1. The adducts may be in the form of the free bases, acid salts or quaternary ammonium salts and are useful as agents for imparting a soft handle to organic fibrous materials, especially paper and textiles.

3 Claims, No Drawings

DIESTER-AMINE ADDUCTS AND PROCESS FOR THEIR MANUFACTURE

The invention relates to diester-amine adducts of the formula

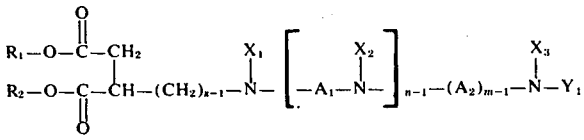

wherein $A_1$ and $A_2$ each denote alkylene with 2 or 3 carbon atoms or 2-hydroxy-n-propylene, $X_1$, $X_2$ and $X_3$ each denote hydrogen, alkyl with 1 to 4 carbon atoms orhydroxyalkyl or hydroxyhalogenoalkyl with 2 to 4 carbon atoms or a radical of the formula

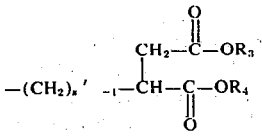

and, if *n* is 3 or 4, the individual $X_2$ radicals are identical or different, $Y_1$ denotes hydrogen, alkyl with 1 to 4 carbon atoms or a radical of the formula

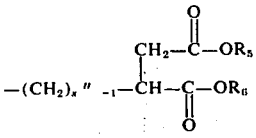

wherein $R_1$, $R_2$, $R_3$, $R_4$, $R_5$ and $R_6$ each denote alkyl or alkenyl with 12 to 22 carbon atoms, *m, s, s' and s''* denote 1 or 2 and *n* denotes 1, 2, 3 or 4, with the ratio of the diester groups to the nitrogen atoms being at most 1:1 and the adducts of the indicated formula being in the form of free bases, acid salts or quaternary ammonium salts.

As a rule, each nitrogen atom of the diester-amine adducts of the formula (1) only carries at most one diester group of the formula (1.1) or (1.2). Accordingly $X_1$ in the formula (1) preferably does not represent a diester group of the formula (1.1). Equally, $X_3$ in the formula (1) preferably does not represent a diester group of the formula (1.1) if $Y_1$ itself corresponds to a diester group of the formula (1.2).

The diester-amine adducts preferably correspond to the formula

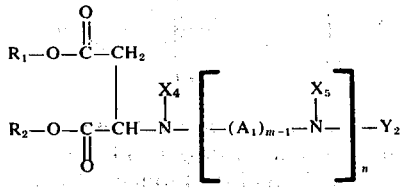

wherein $X_4$ and $X_5$ each denote hydrogen, alkyl with 1 to 4 carbon atoms or hydroxyalkyl or hydroxyhalogenoalkyl with 2 to 4 carbon atoms, $Y_2$ denotes hydrogen, alkyl with 1 to 4 carbon atoms or a radical of the formula

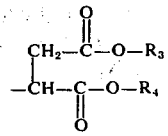

and $A_1$, $R_1$, $R_2$, $R_3$ and $R_4$ have the indicated meaning.

Further advantageous products are the compounds of the formula (1) which do not correspond to compounds of the formula (2).

It is further preferred that these adducts correspond to the formula

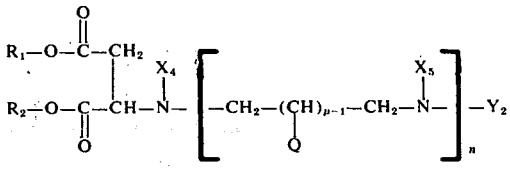

or especially to the formula

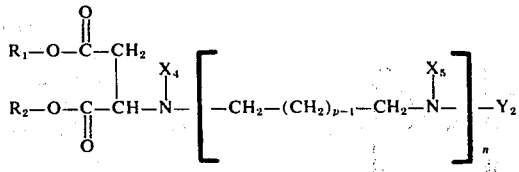

wherein Q denotes hydrogen or hydroxyl and *p* denotes 1 or 2 and $R_1$, $R_2$, $X_4$, $X_5$, $Y_2$ and n have the indicated meaning.

$A_1$ and $A_2$ thus preferably represent a 2-hydroxy-n-propylene radical or especially an ethylene or propylene radical.

Special interest also attaches to adducts of the formula

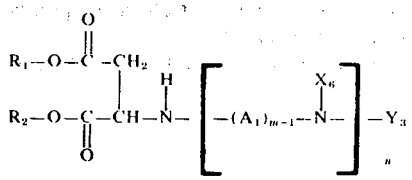

(5)

and above all of the formula

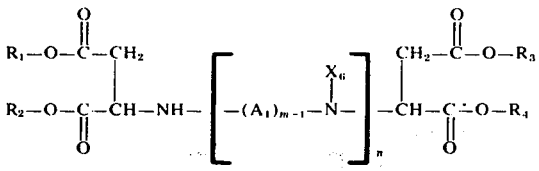

(6)

wherein $X_6$ denotes hydrogen or alkyl with 1 or 2 carbon atoms and $Y_3$ denotes hydrogen, alkyl with 1 or 2 carbon atoms or a radical of the formula (2.1) and $R_1$, $R_2$, $R_3$, $R_4$, $A_1$, *m* and *n* have the indicated meaning.

In $X_1$, $X_2$, $X_3$, $X_4$ and $X_5$ or $X_6$, alkyl is, for example, n-butyl, tert.butyl, isopropyl, n-propyl and above all ethyl or methyl.

Hydroxyalkyl in the definition of $X_1$, $X_2$, $X_3$, $X_4$ and $X_5$ denotes, for example, 2-hydroxyethyl or 4-hydroxy-n-butyl. Preferably, the radicals $X_1$, $X_2$, $X_3$, $X_4$, $X_5$ and $X_6$ represent methyl or especially hydrogen.

Alkyl in $Y_1$, $Y_2$ or $Y_3$ can have the same meaning as for $X_1$, $X_2$, $X_3$, $X_4$, $X_5$ and $X_6$.

Further very suitable adducts correspond to the formula

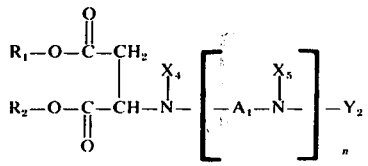

(7)

or

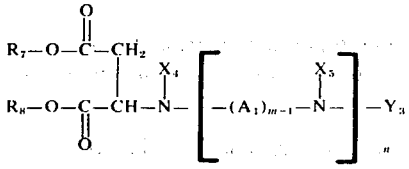

(8)

wherein $Y_3$ denotes hydrogen, alkyl with 1 or 2 carbon atoms or a radical of the formula

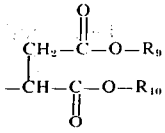

(8.1)

and $R_7$, $R_8$, $R_9$ and $R_{10}$ each denote alkyl or alkenyl with 16 to 18 carbon atoms, and $R_1$, $R_2$, $Y_2$, $A_1$, $X_4$, m and n have the indicated meaning.

$R_1$, $R_2$, $R_3$, $R_4$, $R_5$ and $R_6$, or $R_7$, $R_8$, $R_9$ and $R_{10}$ are preferably radicals which are derived from branched or unbranched, saturated or ethylenically unsaturated, aliphatic alcohols. These can be, for example, dodecyl, tridecyl, myristyl, cetyl, behenyl or especially stearyl or oleyl. The radicals $R_1$ to $R_6$ or $R_7$ to $R_{10}$ can be identical to one another or different from one another.

Advantageous results are above all also achieved with adducts of the formula

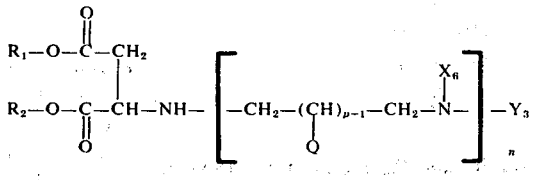

(9)

and especially of the formula

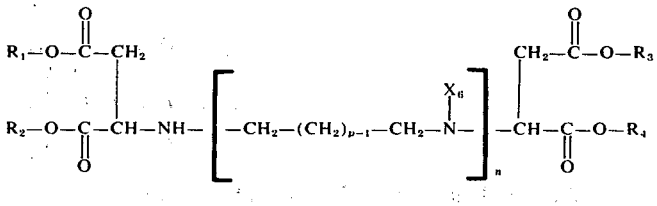

(10)

wherein $R_1$, $R_2$, $R_3$, $R_4$, $X_6$, $Y_3$, Q, n and p have the indicated meaning.

The adducts of the formulae (1) to (10) can, as already mentioned, be in the form of free bases, acid salts or quaternary ammonium salts.

The basic adducts are converted into the acid salts by taking up the adducts in water and neutralising with acids. For this it is possible to use, for example, hydroxyalkylcarboxylic acids or alkylcarboxylic acids with 1 to 3 carbon atoms or a diester of phosphorous acid such as, for example, formic acid, acetic acid, lactic acid or dimethyl phosphite.

The acid salts are preferred to the free bases and the quaternary ammonium salts.

The quaternary ammonium salts are obtained by quaternising adducts possessing tertiary nitrogen atoms with customary quaternising agents such as alkyl halides or dialkyl sulphates, for example methyl chloride, dimethyl sulphate or diethyl sulphate.

Very particular interest attaches to adducts of the formula

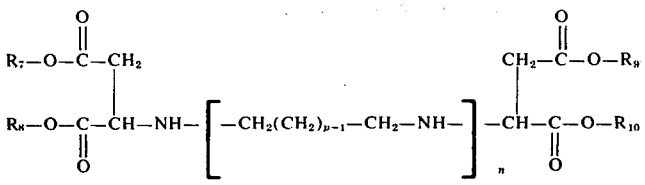

(11)

wherein $R_7$, $R_8$, $R_9$, $R_{10}$, n and p have the indicated meaning, with these adducts being in the form of acid salts, especially of acid salts of acid of the previously indicated type.

The adducts of the formulae (1) to (11) are obtained according to methods which are in themselves known.

The process for the manufacture of diester-amine adducts of the formula (1) is characterised in that (a) at least one diester of an unsaturated dicarboxylic acid of the formula

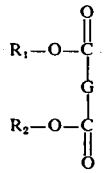

(12)

wherein G represents a radical of the formula

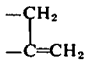

(12.1)

or

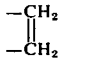

(12.2)

and $R_1$ and $R_2$ have the indicated meaning, is reacted with (b) an amine of the formula

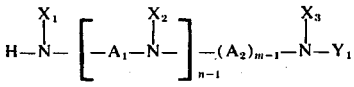

(13)

wherein $A_1$, $A_2$, $X_1$, $X_2$, $X_3$, $Y_1$, m and n have the indicated meaning, in the presence of an organic solvent or in bulk, at temperatures of 15° to 100°C and (c) is optionally reacted with a 1,2-alkylene oxide or an epihalogenohydrin, in each case with at most 4 carbon atoms and (d) the adducts thus obtained are optionally converted into the corresponding acid salts or quaternary ammonium salts by addition of acid or of a quaternising agent, respectively.

The reaction of the diester of the formula (12) with an amine of the formula (13), in which $X_1$, $X_2$ and $X_3$ or $Y_1$ do not already represent a diester in every case can either be carried out in several steps, with diesters which in each case differ from one another, or be carried out all at once with a single diester.

For this reaction, the component (b) used is preferably an amine of the formula

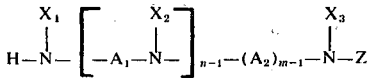

(14)

wherein Z denotes hydrogen or alkyl with 1 to 4 carbon atoms and $A_1$, $A_2$, $X_1$, $X_2$, m and n have the indicated meaning.

Analogously, the diester-amine adducts of the formula (2) can be manufactured by employing (a) a diester of an unsaturated dicarboxylic acid of the formula

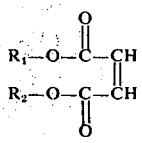

(15.1)

or

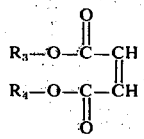

(15.2)

wherein $R_1$, $R_2$, $R_3$ and $R_4$ have the indicated meaning, (b) an amine of the formula

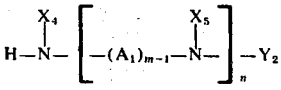

(16)

wherein $A_1$, $X_4$, $X_5$, $Y_2$, Z, m and n have the indicated meaning, (c) optionally, a 1,2-alkylene oxide or a epihalogenohydrin with at most 4 carbon atoms each and (d) optionally an acid or a quaternising agent.

The diester-amine adducts of the formula (2) can also be manufactured by preferably employing, as component (b), an amine of the formula

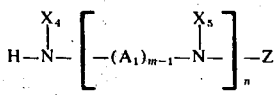

(17)

wherein $A_1$, $X_4$, $X_5$, Z, *m* and *n* have the indicated meaning.

The diesters of the formula (12.1) are itaconic acid diesters whilst those of the formulae (12.2) or (15.1) or (15.2) are preferably fumaric acid diesters or above all maleic acid diesters.

These diesters are obtained according to known processes by reaction of maleic anhydride or esterification of maleic acid, fumaric acid or itaconic acids, or transesterification of lower maleic acid esters, fumaric acid esters or itaconic acid esters with alkanols or alkenols which contain 12 to 22 carbon atoms. Suitable alcohols of this type are, for example, dodecyl alcohol, tridecyl alcohol, myristyl alcohol, cetyl alcohol, behenyl alcohol or especially stearyl alcohol or oleyl alcohol.

Accordingly, preferred diesters correspond to the formula

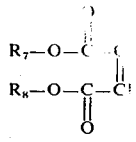

(18.1)

or

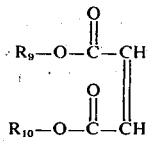

(18.2)

wherein $R_7$, $R_8$, $R_9$ and $R_{10}$ have the indicated meaning.

The amines of the formulae (13), (14), (16) and (17) are as a rule aliphatic saturated polyamines with 2 to 5 amino groups such as, for example, 2-diethylamino-1-ethylamine, 3-dimethylamino-1-propylamine, 3-diethylamino-1-propylamine, N,N-bis-(3-aminopropyl)-methylamine, 1,3-diaminopropanol-2, ethylenediamine, diethylenetriamine, triethylenetetramine or tetraethylenepentamine or hydrazine. Instead of individual amines, mixtures of 2 or more amines can also be employed.

To manufacture the adducts of the formulae (3) and (9) amines of the formula

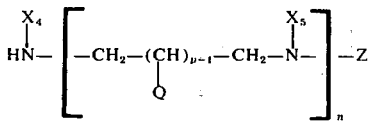

(19)

are used, wherein $X_4$, $X_5$, Q, Z, n and p have the indicated meaning.

Adducts of the formulae (4) and (10) are obtained when using amines of the formula

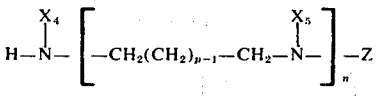

(20)

wherein $X_4$, $X_5$, Z, n and p have the indicated meaning.

To manufacture the adducts of the formula (5), amines of the formula

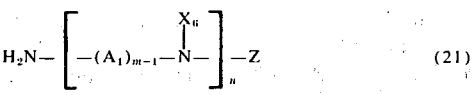

(21)

are used, whilst to manufacture the adducts of the formula (6), amines of the formula

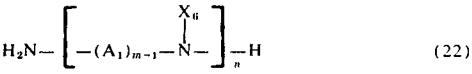

(22)

are used, wherein $A_1$, $X_6$, m and n have the indicated meaning.

Adducts of the formulae (7) and (11) are obtained using amines of the formulae

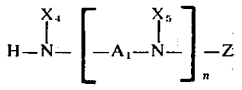

(23)

or

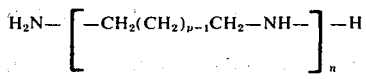

(24)

wherein $X_4$, $X_5$, $A_1$, Z, n and p have the indicated meaning.

The amines of the formula (17) also yield the adducts of the formula (8).

The manufacture of the adducts from the components (a) and (b) is carried out according to a reaction principle which resembles the Michael addition, in the presence of organic solvents such as, for example, dioxane, tert.butanol or benzene, or preferably in bulk, that is to say in the absence of solvents.

The preferred temperature range for this reaction is 20° to 80°C. In most cases an exothermic reaction starts at room temperature and is completed by brief heating to temperatures of up to 100°C, preferably 80°C.

The basic adducts can, as already mentioned, be converted into acid salts or quaternary ammonium salts. This yields solutions or, preferably, stable emulsions. It can at times be desirable furthermore to add emulsifying auxiliaries, for example non-ionic substances such as fatty alcohol polyethylene glycol ethers or alkylphenol polyethylene glycol ethers.

The components (a) and (b) are as a rule reacted with one another in a molar ratio of 5:1 to 1:1, preferably 2:1 to 1:1. Preferably, in this reaction, in every case only one diester reacts with each amino group of the component (b).

Ester-amine adducts which still possess secondary nitrogen atoms can additionally be reacted with the component (c). This optional component (c) is an epihalogenohydrin such as epibromohydrin or above all epichlorohydrin, or a 1,2-alkylene oxide such as 1,2-butylene oxide, 1,2-propylene oxide or especially ethylene oxide.

The reaction with the component (c) is appropriately carried out immediately following the reaction of (a) and (b) either in bulk or in an organic solvent, in the same way as indicated for the reaction of (a) with (b). Preferably, this reaction with (c) takes place at temperatures of 20 to 80°C, especially 25° to 60°C.

At this temperature, a polyaddition of the component (c) cannot take place, but merely the addition of (c) to any secondary nitrogen atom of the diester-amine adducts of (a) and (c) which is still free. In this reaction, at most 4 mols of ethylene oxide (c) react per mol of amine (b) of one of the formulae (13), (14), (16) or (17), in which n represents 4, since at least one of the 5 secondary nitrogen atoms in the diester-amine adduct carries a diester group.

As a rule, however, the components (c) and (b) are reacted with one another in a molar ratio (c):(b) of 1:1 to 2:1.

The adducts can contain some amide structures resulting from the reaction of primary and secondary amino groups with ester groups. Thus, with increasing reaction temperature and time, the proportions of amide structure produced can increase to as much as 30%, this proportion can be determined indirectly by titrating the amino groups with perchloric acid in glacial acetic acid.

The diester-amine adducts of the formulae (1) to (11) and their acid salts or quaternary ammonium salts are very suitable for imparting a soft handle to organic fibre material such as paper or especially textiles. Particularly good soft handle effects are obtained when using loose fibres, yarns and especially woven fabrics or knitted fabrics of natural cellulose, for example cotton, or of polyacrylonitrile. Furthermore, fibre materials of synthetic polyamides or regenerated cellulose can also be given a soft handle by means of these adducts. Good softening effects are achieved with deposits of as little as, for example, 0.1 to 1%, preferably 0.2 to 0.6%, on the fabric.

In the treatment of the fibres the procedure followed is to treat these fibre materials with a preferably aqueous preparation, for example an aqueous solution or emulsion, of these adducts, to apply the adducts to the fibres in this way and subsequently dry the material. Appropriately, 0.5 to 5%, and preferably 1 to 3%, of an approx. 20% strength emulsion or solution are used relative to the weight of the fibre materials to be finished. The aqueous preparations can be applied to the fibres in accordance with the customary impregnation processes known in the textile industry (for example padding processes or exhaustion processes). Solutions in organic solvents are frequently applied by spraying.

In the same way, paper webs can be treated with the adducts by spraying or dipping, and again a fine supple handle is achieved.

Depending on the nature and the ratio of the amounts of the alcohol used for the manufacture of the diester and of the amine employed for the addition reaction, the hydrophilic character and the absorbency, for example of cotton towelling, is influenced to a greater or lesser extent. Thus, for example, the good absorbency of cotton towelling is retained when using oleyl ester adducts whilst stearyl ester adducts completely annul the absorbency of cotton towelling.

The cationic adducts in question furthermore have the advantage that they do not significantly reduce the degree of whiteness of fabrics which have already been brightened.

Furthermore, the diester-amine adducts can be used as anti-static agents for textiles, especially for polyester fabrics.

In the manufacturing instructions and examples which follow, parts denote parts by weight and percentages denote percentages by weight.

Manufacturing instructions for the diesters

A. 134 parts of oleyl alcohol, 49 parts of maleic anhydride and 0.5 part of di-[tert.-butyl]-p-cresol are warmed to 90°C for 2 hours in a stirred vessel, whilst passing nitrogen over the mixture. Thereafter, 134 parts of oleyl alcohol, 250 parts of benzene and 3 parts of 96% strength sulphuric acid are added to the mixture, the solution is heated to the boil and 10 parts of water are distilled off azeotropically over the course of 90 minutes, until the distillate is clear. The solution is cooled to 40°C, mixed with 13 parts of anhydrous sodium carbonate and stirred for 30 minutes. The salt is filtered off and the solvent is distilled from the filtrate in vacuo. 300 parts of diester are obtained as a light yellow liquid, corresponding to quantative conversion. Examination by thin layer chromatography shows that the diester is present as a single substance and contains neither maleic acid or oleyl alcohol. The infra-red spectrum is shown in table I.

The following are reacted in accordance with the process described under A:

B. at 90°C:
67 parts of oleyl alcohol
67.5 parts of stearyl alcohol
49 parts of maleic anhydride
1 part of di-[tert.-butyl]-p-cresol
at the boil:
134 parts of oleyl alcohol
200 parts of benzene
3 parts of 96% strength sulphuric acid.

C. at 90°C:
93 parts of dodecyl alcohol
49 parts of maleic anhydride
0.5 part of di-[tert.-butyl]-p-cresol
at the boil:
93 parts of dodecyl alcohol
200 parts of benzene
3 parts of 96% strength sulphuric acid D. at 90°C:
117 parts of oleyl alcohol
17 parts of stearyl alcohol
49 parts of maleic anhydride
0.5 part of di-[tert.-butyl]-p-cresol
50 parts of benzene
at the boil:
134 parts of oleyl alcohol
200 parts of benzene
3 parts of 96% strength sulphuric acid E. at 90°C:
100 parts of oleyl alcohol
34 parts of stearyl alcohol
49 parts of maleic anhydride
0.5 part of di-[tert.-butyl]-p-cresol
50 parts of benzene
at the boil:
134 parts of oleyl alcohol
200 parts of benzene
3 parts of 96% strength sulphuric acid F. at 90°C:
121 parts of cetyl alcohol
49 parts of maleic anhydride
0.5 part of di-[tert.-butyl]-p-cresol
50 parts of benzene
at the boil:
121 parts of cetyl alcohol
200 parts of benzene
3 parts of 96% strength sulphuric acid G. at 90°C:
30 parts of behenyl alcohol
42 parts of oleyl alcohol
24.5 parts of maleic anhydride
0.5 part of di-[tert.-butyl]-p-cresol
30 parts of benzene
at the boil:
67 parts of oleyl alcohol
130 parts of benzene 2 parts of 96% strength sulphuric acid H. 77 parts of oleyl alcohol, 57 parts of stearyl alcohol, 49 parts of maleic anhydride and 0.5 part of di-[tert.-butyl]-p-cresol are warmed for 2 hours at 90°C in a stirred vessel whilst passing nitrogen over the mixture. Thereafter, 134 parts of oleyl alcohol and 2 parts of 96% strength sulphuric acid are added to the mixture, which is held for 3 hours under a water pump vacuum at 75°C, during the course of which about 10 parts of water are distilled off. The melt is cooled to 40°C and vigourously stirred with 10 parts of anhydrous sodium carbonate for 30 minutes. The salt is filtered off. About 300 parts of diester are obtained as a light yellow liquid.

I. 211 parts of oleyl alcohol, 57 parts of stearyl alcohol, 58 parts of fumaric acid, 0.5 part of di-[tert.-butyl]-p-cresol, 300 parts of toluene and 2 parts of 96% strength sulphuric acid are heated to the boil whilst passing nitrogen over the mixture. 18 parts of water are distilled off azeotropically over the course of about 4 hours. The solution is cooled to 20°C and vigorously stirred with 10 parts of anhydrous sodium carbonate. The salt is filtered off and the solvent is distilled from the filtrate in vacuo. About 300 parts of diester are obtained as a light yellow liquid.

J. The following are reacted in accordance with the process described under I:

211 parts of oleyl alcohol
57 parts of stearyl alcohol
64.5 parts of itaconic acid
0.5 part of di-[tert.-butyl]-p-cresol
2 parts of 96% strength sulphuric acid

EXAMPLES OF THE MANUFACTURE OF DIESTER-AMINE ADDUCTS

EXAMPLE 1

30.7 parts of the diester A and 3.3 parts of tetraethylenepentamine are kept for 1 hour at 50°C and 2 hours at 80°C, with gentle stirring. The resulting clear, liquid adduct corresponds to the formula

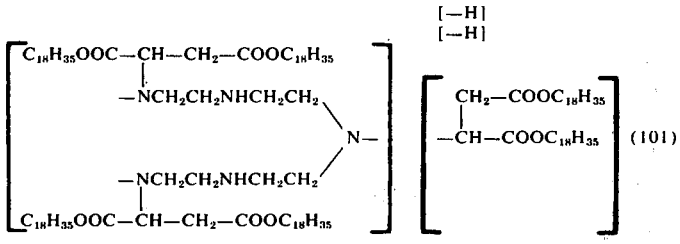

(101)

of which the structure is confirmed by the infra-red spectrum (compare table I).

Examination by thin layer chromatography shows that the adduct contains neither free diester nor free amine. The adduct is next cooled to 50°C, 120 parts of water are added and the pH is adjusted to between 4.5 and 5.0 with 30% strength formic acid, whilst stirring, whereupon a stable, almost colourless 20% strength emulsion results.

The following are reacted in accordance with the process described under Example 1:

EXAMPLE 2:

30.7 parts of the diester A and 2.4 parts of diethylene triamine. The resulting adduct corresponds to the formula

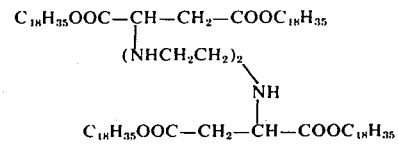

(102)

of which the structure is confirmed by the infra-red spectrum (compare table I).

Thereafter the adduct is cooled to 50°C, 120 parts of water are added and the pH is adjusted to between 4.5 and 5.0 with 30% strength formic acid, whilst stirring, whereupon a stable, almost colourless 20% strength emulsion is produced.

EXAMPLE 3:

30.7 parts of the diester A and 3.6 parts of N,N-bis-(3-aminopropyl)-methylamine. The resulting adduct corresponds to the formula

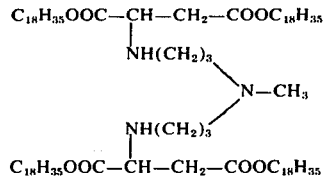

(103)

of which the structure is confirmed by the infra-red spectrum (compare table I).

Thereafter the adduct is cooled to 50°C, 120 parts of water are added and the pH is adjusted to between 4.5 and 5.0 with 30% strength formic acid, whilst stirring, whereupon a stable, almost colourless 20% strength emulsion is produced.

EXAMPLE 4:

30.7 parts of the diester A and 5.1 parts of 3-dimethylamino-1-propylamine. The resulting mono-adduct corresponds to the formula

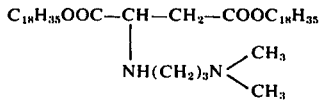

(104)

of which the structure is confirmed by the infra-red spectrum (compare table I). When neutralised with formic acid the mono-adduct gives a 20% strength paste from which a solution is produced by dilution with water.

EXAMPLE 5:

30.7 parts of the diester B and 5.1 parts of 3-dimethylamino-1-propylamine. The resulting mono-adduct corresponds to the formula

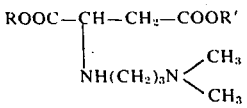

R,R' = 25 mol% $C_{18}H_{37}$
75 mol% $C_{18}H_{35}$ (105)

of which the structure is confirmed by the infra-red spectrum (compare table I). When neutralised with formic acid the mono-adduct gives a 20% strength paste from which a solution is produced by dilution with water.

EXAMPLE 6:

30.7 parts of the diester A and 1.5 parts of ethylenediamine. The resulting adduct corresponds to the formula

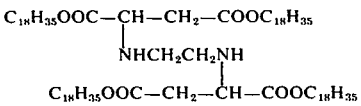

(106)

of which the structure is confirmed by the infra-red spectrum (compare table I). 70 parts of water and 0.4 part of a condensation product of hydroabietyl alcohol and 20 mols of ethylene oxide are added to the adduct and the pH is adjusted to 4.5 with dimethylphosphite, whereupon a stable, colourless 30% strength emulsion is produced.

EXAMPLE 7:

30.7 parts of the diester A and 1.5 parts of ethylenediamine. The resulting adduct also corresponds to the formula (106) of Example 6, of which the structure is confirmed by the infra-red spectrum (compare table I). 70 parts of water and 0.2 part of a condensation product of nonylphenol and 9 mols of ethylene oxide are added to the adduct and the pH is adjusted to 4.5 with formic acid, whereupon a stable, colourless 30% strength emulsion is produced.

EXAMPLE 8:

30.7 parts of the diester B and 1.5 parts of ethylenediamine. The resulting adduct corresponds to the formula

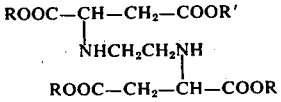

R,R' = 25 mol% $C_{18}H_{37}$
75 mol% $C_{18}H_{35}$ (107)

of which the structure is confirmed by the infra-red spectrum (compare table I). 120 parts of water and 0.3 part of a condensation product of hydroabietyl alcohol and 9 mols of ethylene oxide are added to the adduct and the pH is adjusted to 3.6 – 4 with dimethylphosphite whilst stirring, whereupon a colourless, stable 20% strength emulsion is produced.

EXAMPLE 9:

45 parts of the diester C and 3 parts of ethylenediamine. The resulting adduct corresponds to the formula

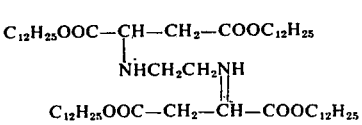

(108)

of which the structure is confirmed by the infra-red spectrum (compare table I).

190 parts of water are added to the adduct and the pH is adjusted to 3.9 with dimethylphosphite whilst stirring, whereupon a stable, colourless 20% strength emulsion is produced.

EXAMPLE 10:

30.7 parts of the diester A, 1.5 parts of 3-dimethylamino-1-propylamine and 1.1 parts of ethylenediamine.

The resulting adduct corresponds to the formulae (104) and (106) of Examples 4 and 6, of which the structure is confirmed by the infra-red spectrum (compare table I).

120 parts of water are added to the adduct and the pH is adjusted to between 4.6 and 5 with lactic acid whilst stirring, whereupon a colourless, viscous emulsion is produced.

EXAMPLE 11:

30.7 parts of the diester D and 2.4 parts of diethylenetriamine. The resulting adduct corresponds to the formula

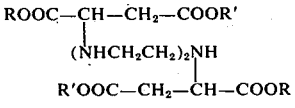

R,R'=6 mol% $C_{18}H_{37}$
94 mol% $C_{18}H_{35}$ (109)

of which the structure is confirmed by the infra-red spectrum (compare table I).

120 parts of water are added to the adduct and the pH is adjusted to between 4.5 and 5 with acetic acid, whilst stirring, whereupon a colourless, stable 20% strength emulsion is produced.

EXAMPLE 12:

30.7 parts of the diester E, 1.3 parts of diethylenetriamine and 0.7 part of ethylenediamine.

The resulting adduct corresponds to the formula

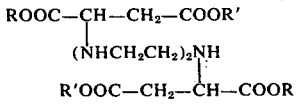

R',R = 12 mol% $C_{18}H_{37}$
88 mol% $C_{18}H_{35}$ (110)

of which the structure is confirmed by the infra-red spectrum (compare table I).

120 parts of water are added to the adduct and the pH is adjusted to between 4.5 and 5 with formic acid, whilst stirring, whereupon a colourless, stable 20% strength emulsion is produced.

EXAMPLE 13:

30.7 parts of the diester D, 1.3 parts of diethylenetriamine and 0.7 part of ethylenediamine.

The resulting adduct corresponds to the formula (109) of Example 11 and to the formula

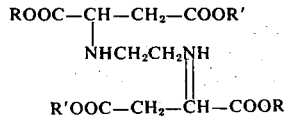

R,R' = 6 mol% $C_{18}H_{37}$
94 mol% $C_{18}H_{35}$ (111)

of which the structure is confirmed by the infra-red spectrum (compare table I).

120 parts of water are added to the adduct and the pH is adjusted to 4.5 with formic acid, whereupon a colourless, stable 20% strength emulsion is produced.

EXAMPLE 14:

30.7 parts of the diester A, 5.1 parts of 3-dimethylamino-1-propylamine and 1 part of 30% strength hydrazine hydrate.

The resulting adduct corresponds to the formula (104) of Example 4 and to the formula

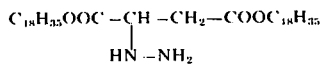

(112)

of which the structure is confirmed by the infra-red spectrum (compare table I).

120 parts of water are added to the adduct and the pH is adjusted to 4.5 with formic acid, whereupon a colourless, pasty 20% strength emulsion is produced.

EXAMPLE 15:

30 parts of the diester F and 2.7 parts of diethylenetriamine.

The resulting adduct corresponds to the formula

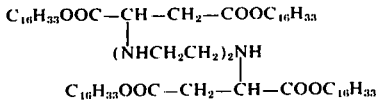

(113)

of which the structure is confirmed by the infra-red spectrum (compare table I).

120 parts of water are added to the adduct and the pH is adjusted to 4 with dimethylphosphite, whereupon a colourless, stable emulsion is produced.

EXAMPLE 16:

32.7 parts of the diester G and 2.5 parts of diethylenetriamine.

The resulting adduct corresponds to the formula

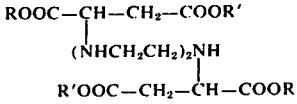

R,R' = 18 mol% $C_{22}H_{45}$
82 mol% $C_{18}H_{35}$ (114)

of which the structure is confirmed by the infra-red spectrum (compare table I).

135 parts of water are added to the adduct and the pH is adjusted to 4 with dimethylphosphite, whereupon a colourless, stable 20% strength emulsion is produced.

EXAMPLE 17:

30.7 parts of the diester A and 3.5 parts of N,N-bis(3-aminopropyl)-methylamine.

The resulting adduct corresponds to the formula (103) of Example 3, of which the structure is confirmed by the infra-red spectrum (compare table I).

The adduct is dissolved in 30 parts of isopropyl alcohol and 4 parts of dimethylformamide and is quaternised by passing methyl chloride into the solution at temperatures between 20° and 50°C. The solvent is distilled off in vacuo. 120 parts of water are added to the residue, whereupon a stable, yellowish-coloured 20% strength emulsion is produced.

EXAMPLE 18:

30.7 parts of the diester A and 1.5 parts of ethylenediamine.

30 parts of dioxane and 2.2 parts of ethylene oxide are added to the adduct and the mixture is kept for 3 hours at 25°C and 30 minutes at 60°C. The resulting adduct, condensed with ethylene oxide, corresponds to the formula

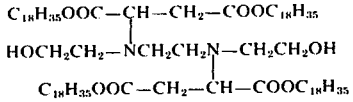

(115)

of which the structure is confirmed by the infra-red spectrum (compare table I).

Thereafter, the solvent is distilled off in vacuo. The residue is taken up in 120 parts of water and the pH is adjusted to 4.5 with formic acid, whereupon a colourless, stable 20% strength emulsion is produced.

EXAMPLE 19:

30.7 parts of the diester A and 2.2 parts of 1,3-diamino-propanol-2.

The resulting adduct corresponds to the formula

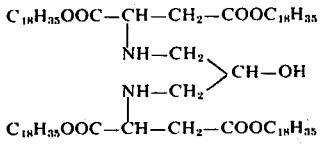

(116)

of which the structure is confirmed by the infra-red spectrum (compare table I).

120 parts of water are added to the adduct and the pH is adjusted to 4 with dimethylphosphite, whereupon a colourless, stable 20% strength emulsion is produced.

EXAMPLE 20:

30.7 parts of the diester A and 2.5 parts of diethylenetriamine.

2.2 parts of epichlorohydrin are added to the adduct and the mixture is kept for 3 hours at 25°C and 30 minutes at 60°C. The resulting adduct, condensed with epichlorohydrin, corresponds to the formula

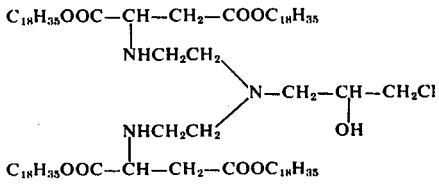

(117)

of which the structure is confirmed by the infra-red spectrum (compare table I). The reaction product is taken up in 120 parts of water and the pH is adjusted to 4.5 with formic acid, whereupon a colourless, stable 20% strength emulsion is produced.

EXAMPLE 21:

30.7 parts of the diester A and 5.8 parts of diethylethylenediamine.

The resulting adduct corresponds to the formula

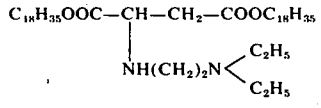

(118)

of which the structure is confirmed by the infra-red spectrum (compare table I).

The adduct is mixed with 1 part of a condensation product of stearyl alcohol and 35 mols of ethylene oxide and the mixture is taken up in 120 parts of water and the pH adjusted to 3.1 with formic acid, whereupon a stable, colourless 20% strength emulsion is produced.

EXAMPLE 22:

50.8 parts of the diester A and 3.1 parts of tetraethylenepentamine.

The resulting adduct corresponds to the formula

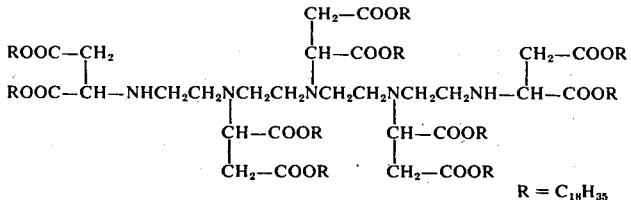

(119)

of which the structure is confirmed by the infra-red spectrum (compare table I).

The adduct is mixed with 2 parts of a condensation product of stearyl alcohol and 35 mols of ethylene oxide and with 8 parts of tetrachloroethylene, the mixture is taken up in 200 parts of water and the pH is adjusted to 3.1 with formic acid, whereupon a stable, yellow 20% strength emulsion is produced.

EXAMPLE 23:

61.5 parts of diester H and 7.2 parts of N,N-bis(3-aminopropyl)-methylamine.

The resulting adduct corresponds to the formula

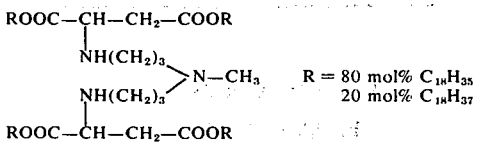

(120)

of which the structure is confirmed by the infra-red spectrum (compare table I).

The adduct is kept under reflux for 8 hours with 40 parts of acetone and 7 parts of dimethylsulphate. The solution is mixed with 2 parts of a condensation product of stearyl alcohol and 35 mols of ethylene oxide and with 8 parts of tetrachloroethylene, the mixture is taken up in 170 parts of water and the pH is adjusted to 3.1 with formic acid, whereupon a stable, colourless 20% strength emulsion is produced.

EXAMPLE 24:

30.8 parts of the diester I and 2.5 parts of diethylenetriamine.

The resulting adduct corresponds to the formula

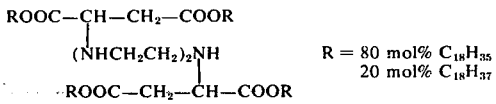

(121)

of which the structure is confirmed by the infra-red spectrum (compare table I).

The adduct is mixed with 1.5 parts of a condensation product of stearyl alcohol and 35 mols of ethylene oxide and with 5 parts of tetrachloroethylene, the mixture is taken up in 120 parts of water and the the pH is adjusted to 3.1 with formic acid, whereupon a stable, colourless 20% strength emulsion is produced.

EXAMPLE 25:

32.5 parts of the diester J and 2.5 parts of diethylenetriamine.

The resulting adduct corresponds to the formula

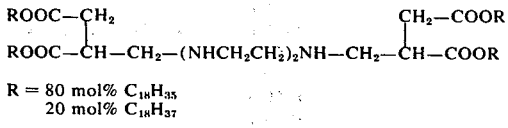

(122)

of which the structure is confirmed by the infra-red spectrum (compare table I).

The adduct is mixed with 1.5 parts of a condensation product of stearyl alcohol and 35 mols of ethylene oxide and with 5 parts of tetrachloroethylene, the mixture is taken up in 120 parts of water and the pH is adjusted to 3.1 with formic acid, whereupon a stable, colourless 20% strength emulsion is produced.

EXAMPLE 26:

30.8 parts of the diester H and 2.5 parts of diethylenetriamine. 5 parts of propylene oxide are added to the adduct and the mixture is kept for 2 hours at 30°C and 30 minutes at 60°C. The resulting adduct, condensed with propylene oxide, corresponds to the formula

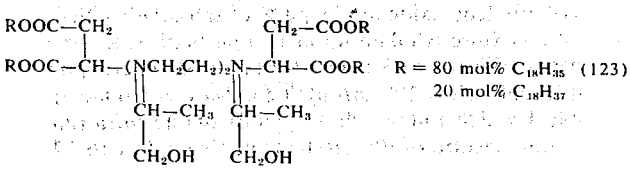

(123)

of which the structure is confirmed by the infra-red spectrum (compare table I).

After adding 0.5 part of a condensation product of stearyl alcohol and 35 mols of ethylene oxide and 5 parts of tetrachloroethylene, the mixture is taken up in 120 parts of water and the pH is adjusted to 3.1 with formic acid, whereupon a stable, colourless 20% strength emulsion is produced.

EXAMPLE 27:

30.8 parts of the diester H and 2.5 parts of diethylenetriamine.

The resulting adduct corresponds to the formula (121) of Example 24. The adduct is mixed with 2 parts of a condensation product of stearyl alcohol and 35 mols of ethylene oxide, and 6 parts of tetrachloroethylene, the mixture is taken up in 120 parts of water and the pH is adjusted to 3.1 with formic acid, whereupon a stable, colourless 20% strength emulsion is produced.

Table I which follows shows bands of the infra-red absorption spectra of the products of Example 1 to 27 and of the starting product manufactured according to manufacturing instructions A.

w = weak absorption m = medium absorption s = strong absorption

TABLE I

| Wave-length in cm⁻¹ | Example No. | | | | | | | | | | | | | | | | | | | | | |
|---|---|---|---|---|---|---|---|---|---|---|---|---|---|---|---|---|---|---|---|---|---|---|
| | A | 1 | 2, 11 12, 16 | 3 17 | 4 5 | 6 7 | 8 | 9 | 10 | 13 | 14 | 15 | 18 | 19 | 20 | 21 | 22 | 23 | 24 | 25 | 26 | 27 |
| 3660 w | | | | | | | | | | | | | x | x | x | | | | | | | |
| 3400 w | | | | | | | | | | | | | | | | | | | x | x | x | |
| 3300 w | | | | | | | | | | | | | | | | | | | x | x | x | |
| 3020 m | x | x | x | x | x | x | x | x | x | x | x | | x | x | x | x | x | x | x | x | x | x |
| 2940 s | x | x | x | x | x | x | x | x | x | x | x | x | x | x | x | x | x | x | x | x | x | x |
| 2870 s | x | x | x | x | x | x | x | x | x | x | x | x | x | x | x | x | x | x | x | x | x | x |
| 2820 m | | | | | x | | | | | | x | | | | | x | x | x | | x | x | |
| 2800 m | | | | | x | | | | | | x | | | | | | | | | | | |
| 2780 m | | | | | x | | | | | | x | | | | | x | | x | | x | | |
| 1730 s | x | x | x | x | x | x | x | x | x | x | x | x | x | x | x | x | x | x | x | x | x | x |
| 1670 m | | | | | | x | x | x | x | | | | x | x | | | | | | | | |
| 1650 m | | x | x | | | | | | | x | | x | | | x | | | | | | | |
| 1645 w | x | | | | | | | | | | | | | | | | | | | | | |
| 1480 m | x | | | | | | | | | | | | | | | | | | | | | |
| 1470 s | x | x | x | x | x | x | x | x | x | x | x | x | x | x | x | x | x | x | x | x | x | x |
| 1390 w | | x | x | x | x | x | x | x | x | x | x | | | x | x | | x | x | x | x | x | x |
| 1370 w | x | | | | | | | x | x | x | | x | x | | x | x | x | x | x | x | | x |
| 1360 w | | x | x | x | x | x | x | x | x | x | x | | x | x | x | | | | | | | |
| 1340 w | | | | | | x | x | x | x | x | | x | x | | | x | x | x | x | x | x | x |
| 1290 w | x | x | x | x | x | x | x | x | x | x | | x | x | x | x | x | x | x | x | x | x | x |
| 1270 w | | | | | | | | | x | | x | | | | | | | | | | | |
| 1260 w | | x | x | x | x | | x | x | | | | | x | x | | x | x | x | x | x | x | x |
| 1250 w | x | | | | | | | | | | | | | | | | | | | | | |
| 1210 m | x | | | | | | | | | | | | | | | | | | | | | |
| 1175 m | | | | | | | | x | | | | | | | x | | | | x | x | | |
| 1170 m | | x | x | x | x | x | x | x | x | x | x | x | x | x | | | | | x | x | | |
| 1160 m | x | x | x | | x | | x | | | | | | x | x | | x | x | x | | | x | x |
| 1120 w | | | | | | | | | | | | | x | | | | | | | x | | |
| 1050 w | | | | | | | | | | | | | x | x | x | x | x | x | | | | |
| 1040 w | | | | x | x | | | x | x | x | x | | | | | | | | | | | |
| 1030 w | | | | | | | | | | | | x | | | | | | x | x | x | x | |
| 980 w | x | x | x | x | | x | x | x | | x | | x | x | x | | | | | | | | x |
| 970 w | | | | | | | | | x | | x | | | | x | x | x | x | | x | | |
| 940 w | | | | | | | | | | | | | | | | | | | x | | | |
| 880 m | | | | | | | | | | | | | x | | | | | | | | | |
| 815 w | | | | | | | | | | | | | | | | | | | | x | x | |
| 690 m | | | | | | | | | | | | | | | x | | | | | x | x | |
| 665 m | | | | | | | | | | | | | | | x | x | x | x | x | x | x | x |

USE EXAMPLES

EXAMPLE 28

The diester-amine adducts of the individual examples are applied by the padding process, as solutions or emulsions of concentrations 10 to 20 g/liter, and are dried at 60° – 100°C.

The soft handle, determined subjectively by several testers, is quoted in table II below in ratings, wherein rating O = no influence on the handle and rating 4 = a very good soft handle. The capillary rise, in percent, also quoted in table II below as a measure of the absorbency, is given relative to 100% for the untreated fabric.

Table II

| Diester-amine adducts according to Example No. | Concentration of the solution or emulsion in g/litre | Cotton towelling | | Cotton tricot | |
|---|---|---|---|---|---|
| | | Soft handle rating | Capillary rise, % | Soft handle rating | Capillary rise, % |
| 2 | 10 | 3.5 | 87 | | |
| | 20 | 3.5 | 61 | | |
| 3 | 20 | 3.5 | 17 | 4 | 86 |
| 4 | 20 | 3.5 | 20 | 3.5 | 55 |
| 5 | 20 | 4 | 0 | 4 | 19 |
| 6 | 20 | 3 | 48 | | |
| 7 | 20 | 3 | 57 | | |
| 8 | 20 | 4 | 4 | | |
| 9 | 20 | 3 | 9 | | |
| Untreated | — | 0 | 100 | 0 | 100 |

EXAMPLE 29:

The diester-amine adduct of Example 27 is applied by the padding process as an emulsion of concentration 2.5 and 7.5 g/liter, and is dried at 60° – 100°C. The handle is assessed as indicated in Example 28. The result is listed in Table III below. The hydrophilic character is determined by the submersion method. A sample of 30 mm diameter (~ 300 mg) is immersed to a depth of approx. 5 cm in distilled water at 20° – 22°C by means of a cotton thread attached to the bottom of the sample. The time which is also shown in Table III below is a measure of complete wetting.

Table III

| Concentration of the solution in g/liter | Cotton towelling | |
|---|---|---|
| | Soft handle | Submersion time |
| 2.5 | 2 | 0 seconds |
| 7.5 | 3.5 | 7 seconds |
| Untreated | 0 | 0 |

EXAMPLE 30:

The diester-amine adduct of Example 27 is applied by the padding process as an emulsion of concentration 10 and 20 g/liter, and is dried at 60° – 100°C. The electrostatic charge is determined in comparison with an untreated sample. The results are listed in Table IV below.

Table IV

| Concentration of the solution in g/liter | Polyester fabric Charge in V/cm against | | | | Surface resistance in Ω/cm² |
|---|---|---|---|---|---|
| | Wool | $T_{1/2}$, sec | Polyvinyl chloride | $T_{1/2}$, sec | |
| Untreated | 17,500 | 71 | 18,500 | 80 | $3 \times 10^{16}$ |
| 10 | 900 | 3 | 4,500 | 2 | $1.4 \times 10^{13}$ |
| 20 | 1,000 | 2 | 1,050 | 1 | $6 \times 10^{12}$ |

$T_{1/2}$ = half-life (time in seconds required for the charge to be reduced to half).

EXAMPLE 31

The diester-amine adducts of the individual examples are absorbed by the exhaustion process, as approx. 20% strength solutions or emulsions at 45°C and pH 4.5, using a liquor ratio of 1:30, for 30 minutes from a bath which is cooling. The concentrations relate to the amounts by weight employed of the approx. 20% strength solutions or emulsions of the diester-amine adducts, relative to the weight of the material to be provided with the finish.

The handle and absorbency are assessed as in Example 28. The results are summarised in Table V below.

In addition, a so-called drop test is carried out which is evaluated in terms of ratings. The results of the evaluation are also summarised in Table V below. In the table, the individual ratings have the following meanings: Rating O: Bead Rating 1: Soaks away within 16 to 45 seconds Rating 2: Soaks away within 6 to 15 seconds Rating 3: Soaks away within ≤ 5 seconds Rating 4: Soaks away immediately Thus, the higher the rating, the better is the desired absorbency.

Table V

| Example No. | Concentration, % emulsion or solution/fabric | Cotton tricot | | Cotton towelling | | Cotton poplin | |
|---|---|---|---|---|---|---|---|
| | | Soft handle rating | Capillary rise % | Soft handle rating | Capillary rise % | Soft handle rating | Capillary rise % |
| 1 | 1 | 2.5 | 86 | 3 | 65 | | |
| | 3 | 3 | 74 | 3.5 | 37 | | |
| 2 | 1 | 3 | 95 | 3 | 75 | 1.5 | 100 |
| | 3 | 3.5 | 95 | 4 | 32 | 2 | 94 |
| 3 | 1 | 2 | 86 | 3.5 | 73 | | |
| | 3 | 3 | 86 | 4 | 18 | | |
| 4 | 1 | 1.5 | 77 | 4 | 64 | | |
| | 3 | 3 | 45 | 4 | 23 | | |
| 5 | 1 | 2 | 36 | 4 | 36 | | |
| | 3 | 2 | 9 | 4 | 0 | | |
| 6 | 1 | | | 4 | 96 | 1 | 106 |
| | 3 | | | 4 | 80 | 2.5 | 94 |

Table V-continued

| | | | | | | | |
|---|---|---|---|---|---|---|---|
| 7 | 1 | | | 2.5 | 96 | | |
| | 3 | | | 4 | 88 | | |
| 10 | 1 | | | 3 | 78 | | |
| | 3 | | | 4 | 52 | | |
| 11 | 1 | | | 3.5 | 78 | | |
| | 3 | | | 4 | 48 | | |
| 12 | 1 | | | 3 | 78 | | |
| | 3 | | | 4 | 52 | | |
| 13 | 1 | | | 2.5 | 87 | | |
| | 3 | | | 3.5 | 74 | | |
| Untreated | — | 0 | 100 | 0 | 100 | 0 | 100 |

| Example No. | Concentration, % emulsion or solution/fabric | Cotton towelling | |
|---|---|---|---|
| | | Soft handle rating | Capillary rise % |
| 14 | 1 | 2 | 81 |
| | 3 | 3 | 65 |
| 15 | 1 | 2 | 85 |
| | 3 | 3.5 | 68 |
| 16 | 1 | 3 | 67 |
| | 3 | 4 | 33 |
| 17 | 1 | 2.5 | 87 |
| | 3 | 3.5 | 70 |
| 18 | 1 | 4 | 89 |
| | 3 | 4 | 80 |
| 19 | 1 | 2 | 100 |
| | 3 | 3.5 | 70 |
| 20 | 1 | 1.5 | 80 |
| | 3 | 3 | 61 |
| 21 | 1 | 3 | 53 |
| | 3 | 4 | 53 |
| 22 | 1 | 1.5 | 88 |
| | 3 | 2.5 | 60 |
| 23 | 1 | 2 | 69 |
| | 3 | 3.5 | 40 |
| 24 | 1 | 1 | 69 |
| | 3 | 3 | 56 |
| 25 | 1 | 1 | 75 |
| | 3 | 2.5 | 56 |
| 26 | 1 | 1.5 | 63 |
| | 3 | 4 | 44 |
| 27 | 1 | 3 | 77 |
| | 2 | 4 | 59 |
| Untreated | — | 0 | 100 |

| Example No. | Concentration, % emulsion or solution/fabric | Polyamide | | | Polyacrylonitrile | | | Polyester/cotton | | | Viscose | | |
|---|---|---|---|---|---|---|---|---|---|---|---|---|---|
| | | Soft handle, rating | Capillary rise, % | Drop, rating | Soft handle, rating | Capillary rise, % | Drop, rating | Soft handle, rating | Capillary rise, % | Drop, rating | Soft handle, rating | Capillary rise, % | Drop, rating |
| 21 | 2 | 1 | 135 | 3 | 3.5 | 80 | 3 | 2 | 67 | 3 | 2.5 | 73 | 4 |
| 22 | 2 | 2 | 115 | 1 | 1.5 | 74 | 2 | 1.5 | 75 | 1 | 2 | 97 | 3–4 |
| 23 | 2 | 1.5 | 100 | 1 | 3.5 | 44 | 1 | 3 | 38 | 1 | 3 | 56 | 1–2 |
| 24 | 2 | 2 | 57 | 0 | 2 | 62 | 1 | 2 | 50 | 0 | 2 | 70 | 3–4 |
| 25 | 2 | 1.5 | 52 | 1 | 2.5 | 41 | 1 | 1.5 | 50 | 0 | 1.5 | 35 | 2 |
| 26 | 2 | 2.5 | 70 | 1 | 2.5 | 56 | 1 | 2.5 | 25 | 0 | 2.5 | 59 | 3 |
| 27 | 2 | 3 | 71 | 1 | 3 | 54 | 1 | 3 | 30 | 0 | 3 | 54 | 2 |
| Untreated | — | 0 | 100 | 1 | 0 | 100 | 2 | 0 | 100 | 2 | 0 | 100 | 3–4 |

What we claim is:

1. Diester-amine adducts of the formula

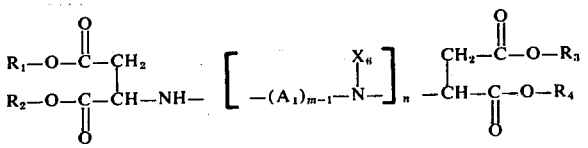

wherein $A_1$ denotes alkylene with 2 or 3 carbon atoms or 2-hydroxy-n-propylene, $m$ is 2, $n$ is an integer from 1 to 4, $R_1$, $R_2$, $R_3$ and $R_4$ each denote alkyl or alkenyl with 12 to 22 carbon atoms, and $X_6$ denotes hydrogen or alkyl with 1 or 2 carbon atoms, these adducts being in the form of free bases, acid salts or quaternary ammonium salts.

2. Diester-amine adducts of the formula

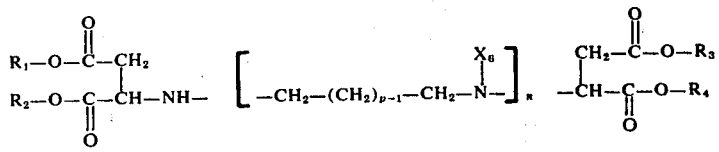

wherein $p$ is 1 or 2, $n$ is 1 to 4, $X_6$ is hydrogen or alkyl of 1 or 2 carbon atoms, and $R_1$, $R_2$, $R_3$ and $R_4$ are alkyl or alkenyl with 12 to 22 carbon atoms, these adducts being in the form of free bases, acid salts or quaternary ammonium salts.

3. Diester-amine adducts according to claim 2 of the formula

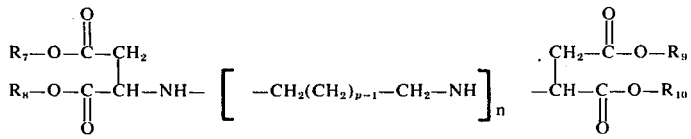

wherein $p$ is 1 or 2, $n$ is 1 to 4, $R_7$, $R_8$, $R_9$ and $R_{10}$ each denote alkyl or alkenyl with 16 to 18 carbon atoms, and wherein this adduct is in the form of an acid salt.

* * * * *